US006363823B1

(12) United States Patent
Myers et al.

(10) Patent No.: US 6,363,823 B1
(45) Date of Patent: Apr. 2, 2002

(54) VARIABLE INDEX DRIVE APPARATUS

(75) Inventors: Terrance L. Myers, Coral Springs, FL (US); Robert L. Vytlacil, Hudson, WI (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 09/100,220

(22) Filed: Jun. 19, 1998

(51) Int. Cl.[7] ..... B65H 17/00

(52) U.S. Cl. ..... 83/241; 83/263; 83/273; 83/593

(58) Field of Search ..... 74/15, 15.2, 15.3, 74/15.84, 15.86, 69, 37, 38, 45, 665.11, 117, 325, 606 R, 664, 820, 689, 863, 745, 740, 730, 424; 83/37, 38, 76, 22, 53, 90, 593, 335, 285, 296, 273–275, 263–265; 474/13

(56) References Cited

U.S. PATENT DOCUMENTS

| | | | | | |
|---|---|---|---|---|---|
| 2,034,778 | A | * | 3/1936 | Storey | 74/15.2 |
| 2,096,605 | A | * | 10/1937 | Blount | 83/285 |
| 2,179,171 | A | * | 11/1939 | Boho | 74/15.2 |
| 2,235,047 | A | | 3/1941 | Sloan | |
| 2,287,279 | A | * | 6/1942 | Stumpf | 74/15.2 |
| 2,337,255 | A | * | 12/1943 | Tourneau | 74/15.84 |
| 2,519,201 | A | * | 8/1950 | Seidman | 83/593 |
| 2,540,224 | A | | 2/1951 | Vasselli | |
| 3,017,796 | A | * | 1/1962 | Auer et al. | 83/263 |
| 3,040,588 | A | * | 6/1962 | Hausmann et al. | 74/15.86 |
| 3,095,774 | A | * | 7/1963 | Hart | 83/285 |
| 3,176,565 | A | * | 4/1965 | Shields | 83/593 |
| 3,287,098 | A | * | 11/1966 | Stuske et al. | 83/593 |
| 3,381,578 | A | * | 5/1968 | Buchanan | 409/50 |
| 3,476,001 | A | * | 11/1969 | Schluter | 83/285 |
| 3,505,889 | A | | 4/1970 | Anderson | |
| 3,628,450 | A | * | 12/1971 | Schmidt | 83/38 |
| 3,668,957 | A | * | 6/1972 | Nido | 83/37 |
| 3,714,858 | A | * | 2/1973 | Lee | 83/263 |
| 3,762,830 | A | * | 10/1973 | Pettigrew | 74/842 |
| 3,779,100 | A | * | 12/1973 | Schmidt | 74/325 |
| 3,934,492 | A | * | 1/1976 | Timbs | 74/740 |
| 4,080,843 | A | * | 3/1978 | Underwood | 74/664 |
| 4,096,767 | A | * | 6/1978 | Peters, Jr. | 83/272 |
| 4,136,751 | A | * | 1/1979 | Poore et al. | 74/15.86 |
| 4,196,645 | A | * | 4/1980 | Shimizu et al. | 83/37 |
| 4,241,618 | A | * | 12/1980 | Smirl | 74/863 |
| 4,268,343 | A | * | 5/1981 | Schulze | 74/69 |
| 4,280,384 | A | * | 7/1981 | Schmidt | 83/273 |
| 4,294,170 | A | * | 10/1981 | Takahashi | 83/244 |
| 4,295,399 | A | * | 10/1981 | Finsterwalder et al. | 83/251 |
| 4,335,498 | A | * | 6/1982 | Hague et al. | 74/820 |

(List continued on next page.)

*Primary Examiner*—M. Rachuba
*Assistant Examiner*—Kim Ngoc Tran
(74) *Attorney, Agent, or Firm*—Wood, Herron & Evans, L.L.P.

(57) ABSTRACT

A machine, for example machine for cutting discrete sheets of material from a web, which includes a web supply and a processing station such as a cutoff station, is provided with a variable index drive operating feed structure for moving the web intermittently a predetermined but adjustable distance. The web is advanced intermittently and at which the frequency that varies in direct relation to the continuous speed of an input drive motor. The amount at which the web is fed during each cycle of the intermittent motion is settable by an operator by varying a continuous dial of a variable index drive. The variable index drive is a mechanical transmission having an index mechanism which produces a first intermittent output, a variable ratio unit connected at the output of the index mechanism for producing a second intermittent output having a speed that differs from the direct output of the index mechanism by the setting of the variable ratio unit, and a differential which produces a variable displacement in each cycle by combining the two outputs.

13 Claims, 3 Drawing Sheets

U.S. PATENT DOCUMENTS 4,347,006 A * 8/1982 Shakib ..... 400/187
4,377,551 A * 3/1983 Adams ..... 376/260
4,458,559 A * 7/1984 Croswhite et al. ..... 74/730
4,553,450 A * 11/1985 Gizard ..... 74/689
4,561,582 A * 12/1985 Wiig ..... 226/142
4,602,527 A 7/1986 Tamiya
4,674,377 A * 6/1987 Groth ..... 83/324
4,691,606 A * 9/1987 Johnson et al. ..... 83/175
4,781,090 A * 11/1988 Feldkamper et al. ..... 83/76
4,848,631 A * 7/1989 Gentile ..... 226/141
4,858,492 A * 8/1989 Takano et al. ..... 74/745
4,864,891 A * 9/1989 Takano et al. ..... 74/745
4,873,879 A * 10/1989 Butterfield et al. ..... 74/689
4,944,198 A 7/1990 Natale et al.
5,052,990 A * 10/1991 Sakakibara et al. ..... 74/424.8
5,069,604 A 12/1991 Al-Sabih
5,370,519 A 12/1994 Shapcott
RE34,833 E * 1/1995 Hasegawa et al. ..... 74/15.2
5,514,040 A * 5/1996 Robert ..... 474/13
5,666,853 A * 9/1997 Stahl ..... 83/593

* cited by examiner

VARIABLE INDEX DRIVE APPARATUS

The present invention relates to mechanical drives and particularly to indexing or intermittent drive linkages. More particularly, the present invention relates to drives for material handling and processing machines such as those in which continuous lengths of material are subjected to cutting or other processing steps at prescribed intervals along the lengths.

BACKGROUND OF THE INVENTION

The performance of intermittent operations along the lengths of continuous materials in automated manufacturing processes has been made increasingly easier with the increased use of electronics and electrical controls. However, while the design and manufacture of equipment with such controls has been rendered easier by technological advances, the use and maintenance of such equipment, particularly in heavier duty processes, has provided certain offsetting disadvantages. For many manufacturing applications where environmental conditions vary, where fluctuations in available power and electrical noise occur, and where the availability of specialized maintenance personnel are limited, heavy duty mechanical linkages and controls are often preferred.

In the manufacture of sheets of building materials and constructions supplies such as sand paper, for example, webs of backing material are coated with an adhesive and then hard particles of hard abrasive material. Such materials are produced as webs that are wound on rolls from which the webs are fed and cut into sheets. In sheet forming processes, the webs are fed by intermittent drives to cut-off devices which cut the webs into sheets of predetermined lengths. While electrically actuated intermittent drives have been used with success, mechanical drives have proved more durable and have resulted in less maintenance and downtime.

Intermittent mechanical drives, while reliable and efficient for repetitive applications in less than ideal environments have not had the flexibility that has been available with electrical drives that have separately controllable motors that can be linked by a controller rather than by mechanical gear trains and mechanical linkages. Intermittent drives that include index devices provide reliable repeatable intermittent operation of feed mechanisms as well as devices for operating on lengths of material that are intermittently fed. Such devices operate at a particular frequency that is determined by the speed of an input drive. Where the same drive is relied upon for moving the web or other material during each indexed cycle of the drive, such drives have also proved reliable. However, where changes in the feed parameters must be made that are independent of the frequency of operation of the indexing device, mechanical drives have not provided great flexibility.

Flexibility in varying drive parameters is required where variations in the dimensions or other parameters of the product must be provided. For example, where sheet material is to be formed by performing intermittent cuts of the material from a continuous web, frequent changes in the desired lengths of the sheet material calls for changes in the drive ratios between the intermittently operating components of the machine and speed or travel distances of other components that affect the motion of the material through the machine. Such variations can be due to a desire, for example, to produce sheets of several different sizes or can be due to the need to adjust for changes in the feed or other motion of the material as a result of variations in material properties or changes in environmental conditions.

Because of the above considerations, there remains a need for greater flexibility in mechanical drives for industrial equipment.

SUMMARY OF THE INVENTION

An objective of the present invention is to provide a mechanical drive that includes an intermittent indexing component that transmits motion at a predetermined frequency as well as a continuously variable component that produces an output motion or stroke that can be changed in a manner that is not necessarily related to the intermittent motion frequency.

A more particular objective of the present invention is to provide an all mechanical drive that produces intermittent yet variable motion or displacement.

In accordance with the principles of the present invention, there is provided a manufacturing or material handling apparatus in which an indexing mechanism or intermittent motion device is serially combined with a continuously variable transmission. Preferably, an indexing mechanism is provided with an input connected to the output of a motor and an output connected to the input of a variable speed differential transmission, through a variable ratio device that permits the changing of the variable speed of the transmission. The combination drive produces motion at the output of the variable speed transmission that responds intermittently at a frequency determined by the speed of the motor, while at the same time produces a displacement for each cycle of operation of the indexing mechanism that can be set and changed in accordance the setting of the variable ratio device.

In the preferred embodiment of the invention, a fixed displacement intermittent motion device such as a ratchet drive, a Geneva drive, a mod-sine drive, a roller gear drive or other intermittent drive, is connected between a drive motor and an variable drive unit. The variable drive unit includes a variable ratio element which has an input driven by the intermittent motion device and two outputs, a first one such as a shaft which rotates at a speed that is fixed relative to the input and a second such as a shaft that varies at a speed that differs from that of the first output by an amount that can be controlled by a mechanical adjustment made by an operator. The two outputs of the variable drive unit are each linked, either directly or through a gear train, to a different one of three input/outputs of a differential drive. The differential produces motion on the third of the three input/outputs that is proportional to the difference in the motions on the other two input/outputs. The variable ratio element and differential may be alternatively connected in three configurations, as will be explained in more detail in connection with the detailed description of the drawings below. In addition, a multiple fixed ratio transmission may be provided in any of the configurations of the drive to provide a selection of variable ranges of adjustment for the drive.

The preferred embodiment of the invention includes such a drive in a system for feeding continuous material from a supply and intermittently operating on the material at points spaced along its length at distances that can be controlled independently of the frequency of the intermittent component of the drive. Preferably, such a system provides for the cutting of controlled lengths of material from a continuous web.

The present invention provides a highly reliable and totally mechanical drive system in which intermittent motion at a desired frequency can be combined with variable displacement that can be set by an operator. The system provides for a highly reliable, low maintenance process that is tolerant of adverse conditions such as those found in heavy manufacturing.

These and other objects of the present invention will be more readily apparent from the following detailed description of the drawings.

DETAILED DESCRIPTION OF THE PREFERRED EMBODIMENT

Figure 1:
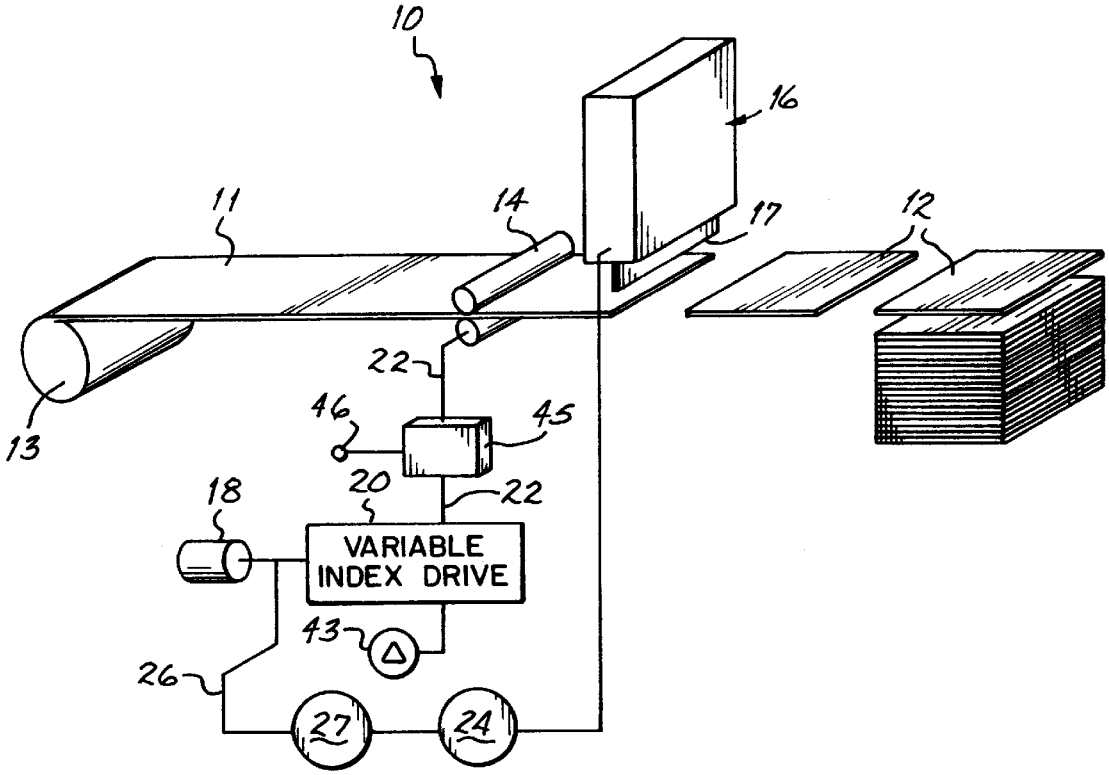
FIG. 1 is diagrammatic perspective view of a roll feeding and sheet cut-off machine embodying principles of the present invention.

FIG. 1 illustrates a machine 10 which feeds a web 11 of industrial abrasive material such as sandpaper, for example, from a roll 13 and cuts the material from the web 11 into sheets 12 of predetermined lengths. The web 11 is fed from the roll 13 by a web advancing mechanism, which includes, for example, a set of drive rollers 14, into a cutoff mechanism 16, at which a cutting element 17, operating intermittently, severs a sheet 12 of the material from the web 11.

The drive rollers 14 are driven by a drive motor 18 through a variable index drive 20. The motor 18 runs, preferably continuously, and turns an input shaft 21 to the variable index drive 20 at a predetermined rotational speed. The drive 20 has an output shaft 22 which operates such that, with each rotation of the input shaft 21, the output shaft 22 rotates from a motionless state through a predetermined angular distance that will rotate the drive rollers 14 an amount that will feed a predetermined length of the web 11 past the cutting element 17, and then stop to stop the web 11 adjacent the cutting element 17 so that a predetermined length of material is cut from the web 11 into a sheet 12 when the cutting mechanism 16 is cycled.

The cutting mechanism 16 may be cycled by the controlled actuation of a cutting mechanism drive 24, which may be electrically or pneumatically or otherwise independently controlled, or, mechanically driven by motor 18. As illustrated, cutoff mechanism drive 24 is driven through a shaft 26 connected from motor 18 through an intermittent drive linkage 27 to the cutoff mechanism drive 24.

Figure 2:
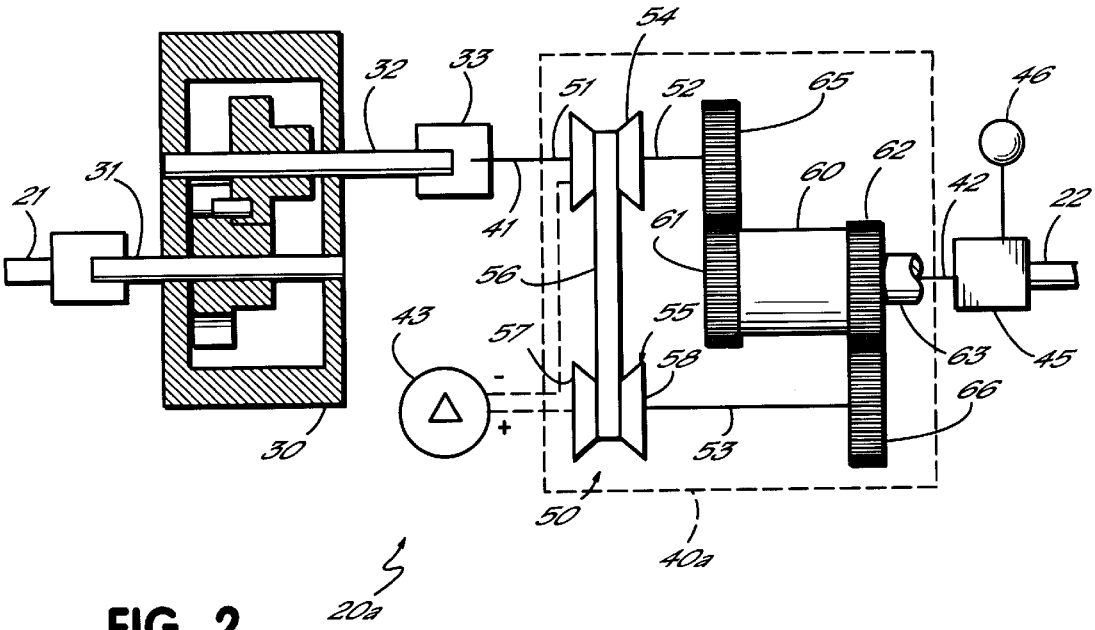
FIG. 2 is a diagram of one embodiment of a variable length intermittent drive of the machine of FIG. 1.
Figure 3:
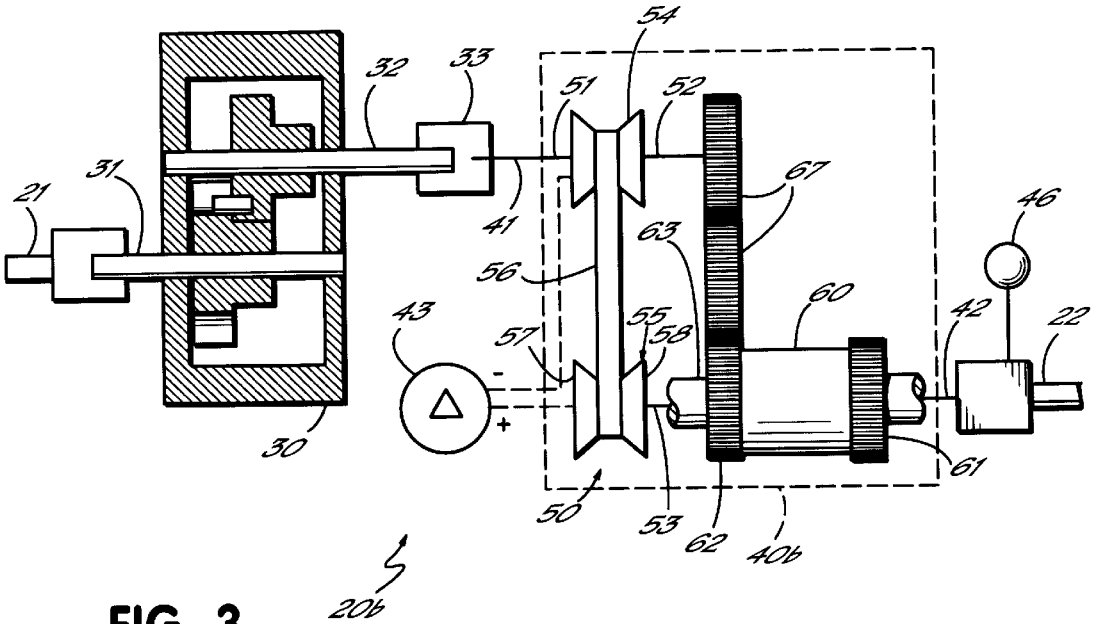
FIG. 3 is a diagram, similar to FIG. 2, of another embodiment of a variable length intermittent drive of the machine of FIG. 1.
Figure 4:
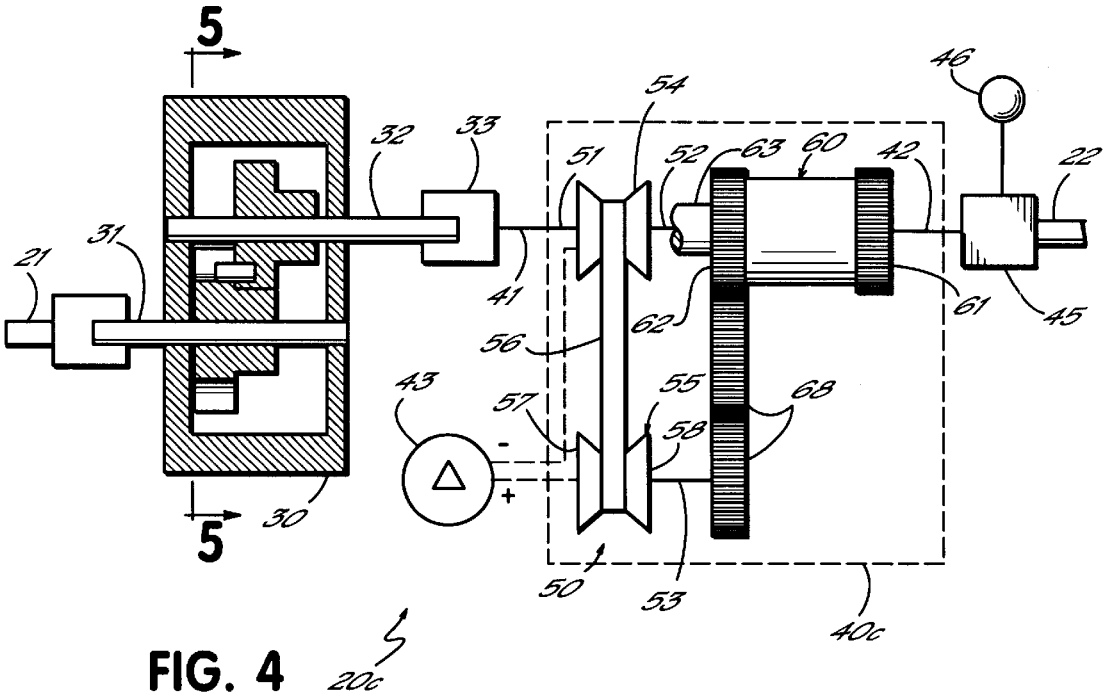
FIG. 4 is a diagram, similar to FIGS. 2 and 3, of another embodiment of a variable length intermittent drive of the machine of FIG. 1.
Figure 5:
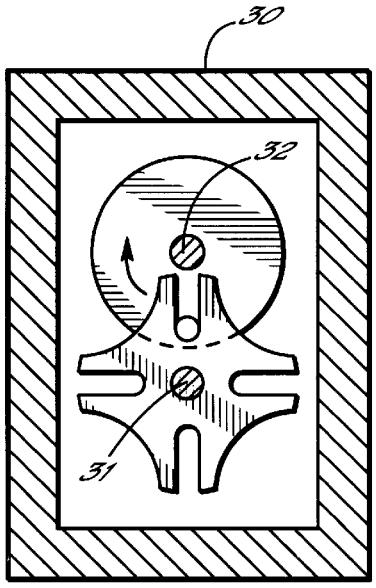
FIG. 5 is a cross-sectional view of through the index mechanism of the intermittent drive of FIG. 2.

The variable index drive 20 is illustrated in three configurations, 20*a*, 20*b* and 20*c*, respectively, in FIGS. 2, 3, and 4. Each configuration of the drive 20 includes a fixed displacement intermittent motion drive 30 such as a ratchet drive, a Geneva drive, a mod-sine drive, a roller gear drive or other intermittent drive, is connected between a drive motor and an variable drive unit having an input shaft 31 connected to the input shaft 21 and an output 32 connected through a coupling 33 to the input shaft 41 of a variable displacement unit, which is illustrated in three respective versions 40*a*, 40*b* and 40*c* in FIGS. 2–4, and which is generically referred to as unit 40. The unit 40 has a displacement adjusting member in the form of, for example, a differential adjustment dial 43, that is capable of being set by an operator. The unit 40 also has an output shaft 42 that is connected to the input of a multiple speed transmission 45. The transmission 45 has an output connected to the drive output shaft 22.

The multiple speed transmission 45 provides, for example, three or four fixed speeds that can be selected by the operation of a shift lever 46 to set the range of displacement adjustment resulting from the setting of the dial 43. While the transmission 45 is preferably connected between the output shaft 42 of the unit 40 and the drive output shaft 22, it may alternatively be placed elsewhere in the drive 20 downstream of the intermittent motion drive 30, particularly between the output 32 of the intermittent motion drive 30 and the input shaft 41 of the unit 40.

Each of the three versions 40*a*, 40*b* and 40*c* of the variable displacement unit 40 includes a variable ratio element 50 which includes an input shaft 51 that is connected to the input shaft 41 of the unit 40, a main shaft 52 that rotates at the same speed as the input shaft 51 and a secondary shaft 53 that rotates at a speed that is proportional to that of the main shaft 52 but may be greater or less than that of the main shaft 52 by an amount determined by a setting of the differential adjustment dial 43. As illustrated, the variable ratio element 50 is provided with a drive pulley 54 rigidly connected to both the shafts 51 and 52 and a driven pulley 55 that is linked to the drive pulley 54 by a V-belt 56. The driven pulley 55 has two halves, 57 and 58, that are spaced apart a distance controlled by the setting of the differential adjustment dial 43, which affects the operative diameter of the pulley 55 to adjust the ratio of the motion of the secondary shaft 53 relative to that of the main shaft 52. Other designs of a variable ratio element 50 are generally known in the art and can be substituted for the embodiment of element 50 that is illustrated and described to perform a comparable function.

Each of the three versions 40*a*, 40*b* and 40*c* of the variable displacement unit 40 also includes a variable drive unit 60 which includes three mechanically linked input/output members. The three input or output members include a first side gear 61, a second side gear 62 and a differential central shaft 63. In the three versions 40*a*, 40*b* and 40*c*, the input/output members 61–63 are differently connected. The three versions 40*a*, 40*b* and 40*c* of the unit 40 provide three different ways for transmitting displacement and power through the drive 20, from which the one such way that is most suitable for a particular application can be selected.

In the version 40*a* of the variable displacement unit 40 illustrated in FIG. 2, side gear 61 is linked through a gear train 65 to the main shaft 52 of the variable ratio element 50 while the side gear 62 is linked through a gear train 66 to the secondary shaft 53 of the element 50. The central shaft 63 of the version 40*a* constitutes the output shaft 42 of the version 40*a* that is linked through the transmission 45 to the drive output shaft 22.

In operation, the input shaft 21 runs continuously to drive the indexing unit 30 to produce intermittent motion on the shaft 32. This motion passes through the variable ratio element 50 to the shaft 52 thereof while a proportional but different intermittent rotation at the same intermittent frequency is produced on the shaft 53 in accordance with the setting of the dial 43. The two rotational motions on shafts 52 and 53 are coupled to the side gears 61 and 62, respectively, through respective gear trains 65 and 66 to the differential 60 where the difference between the two rotational motions from shafts 51 and 52 is produced on the central shaft 63, and thus on the drive output 22.

Alternatively, in the version 40*b* of the variable displacement unit 40 illustrated in FIG. 3, side gear 61 constitutes the output shaft 42 of the version 40*a* that is linked through transmission 45 to the drive output shaft 22. The side gear 62 is linked through a gear train 67 to the main shaft 52 of the variable ratio element 50 while the central shaft 63 is linked to the secondary shaft 53 of the element 50.

In operation, the input shaft 21 runs continuously to drive the indexing unit 30 to produce intermittent motion on the shaft 32, which passes through the variable ratio element 50 to the shaft 52 while the proportional but different intermittent rotation at the same intermittent frequency is produced on the shaft 53 in accordance with the setting of the dial 43. The two rotational motions on shafts 52 and 53 are coupled to the side gear 62 and central shaft 63, respectively, to the differential 60 where the difference between the two rotational motions from shafts 51 and 52 is produced on the side gear 61, and thus on the drive output 22.

As a further alternative, in the version 40*c* of the variable displacement unit 40 illustrated in FIG. 4, side gear 61 again constitutes the output shaft 42 of the version 40*a* that is linked through transmission 45 to the drive output shaft 22. The central shaft 63 is linked through to the main shaft 52 of the variable ratio element 50 while the side gear 62 is linked through a gear train 68 to the secondary shaft 53 of the element 50. While the gear trains 65–68 are preferably fixed ration gear trains, they may alternatively be multiple discrete speed transmissions by which the range of adjustment provided by the displacement adjustment dial 43 can be changed.

In operation, the input shaft 21 runs continuously to drive the indexing unit 30 to produce intermittent motion on the shaft 32 and the shaft 52 while the proportional intermittent rotation is produced on the shaft 53 in accordance with the setting of dial 43. The rotational motions on shafts 52 and 53 are coupled to the side gear 62 and central shaft 63, respectively, to the differential 60 where the difference between the two rotational motions is produced on the side gear 61 and on the drive output 22.

With all of the versions of the unit 40, when used in the apparatus 10, the web material 11 can be fed to the cutting station 16 and cut into precise lengths of sheets 12 in accordance with the sheet size adjustment made by the operator through the dial 43.

The above description is representative of certain preferred embodiments of the invention. Those skilled in the art will appreciate that various changes and additions may be made to the embodiments described above without departing from the principles of the present invention. Therefore, the following is claimed:

What is claimed is:

1. An apparatus for performing intermittent operations at discrete spaced lengths on a continuous web of material, the apparatus comprising:

a variable displacement intermittent drive including:

a rotary input shaft, a rotary output shaft, a displacement adjusting member having a variable position, a mechanical transmission connected between the input shaft and the output shaft for transmitting continuous rotary motion of the input shaft to intermittent unidirectional rotary motion of the output shaft, the intermittent unidirectional rotary motion including a recurring cycle having a frequency directly proportional to the rotary motion of the input shaft, each cycle having a motion that includes a dwell portion during which the rotary motion of the output shaft is essentially zero and a displacement portion during which the rotary motion of the output shaft has an angular displacement that varies in relation to the position of the displacement adjusting member, the transmission including:

an index drive element having an input shaft coupled to the input shaft of the drive and an output shaft, a continuously variable transmission unit having variable displacement output shaft responsive to the position of the displacement adjusting member, and a differential drive having three input/outputs, one linked to the output shaft of the index drive element, one linked to the variable displacement output shaft of the continuously variable transmission unit and one linked to the output shaft of the drive;

a processing station operative to work on the material at the station during the dwell portion of each cycle;

a material supply for directing a web of material therefrom to the processing station; and web feed elements connected to the output shaft of the drive and operable to advance, from the supply to the processing station during the displacement portion of each cycle, a length of the web determined at least in part by the position of the displacement adjusting member.

2. The drive of claim 1 wherein:

the processing station includes a cut off mechanism operative to sever, from the web during the dwell portion of each cycle, discrete sheets of the material having lengths equal to said determined length of the web.

3. A variable displacement intermittent drive comprising:

a rotary input shaft;

a rotary output shaft;

a displacement adjusting member having a variable position;

a mechanical transmission connected between the input shaft and the output shaft for transmitting continuous rotary motion of the input shaft to intermittent unidirectional rotary motion of the output shaft, the intermittent unidirectional rotary motion including a recurring cycle having a frequency directly proportional to the rotary motion of the output shaft, each cycle having a motion that included a dwell portion during which the rotary motion of the output shaft is essentially zero and a displacement portion during which the rotary motion of the output shaft has a angular displacement adjusting member, the transmission including:

an index drive element having an input shaft couple to the input shaft of the drive an a output shaft, a continuously variable transmission unit having variable displacement output shaft responsive to the position of the displacement member, and a differential drive having three input/output, one linked to the output shaft of the index drive element, one linked to the variable displacement output shaft of the continuously variable transmission unit and one linked to the output shaft of the drive.

4. The drive of claim 3 wherein:

the transmission further includes a multiple speed gear train connected in series with the continuously variable transmission unit and the differential.

5. A variable displacement intermittent drive comprising:

an input shaft;

an output shaft;

an adjustment element;

a mechanical transmission connected between the input shaft of the intermittent drive and the output shaft of the drive for transmitting continuous rotary motion of the input shaft of the intermittent drive to intermittent motion of the output shaft of the drive at a frequency that is directly proportional to the rotary motion of the input shaft of the intermittent drive, the transmission including:

an index drive having an input shaft driveably coupled to the input shaft of the intermittent drive and having an output shaft producing unidirectional, intermittent rotation of a fixed displacement at said frequency, and continuously variable transmission means for transmitting intermittent rotation from the output shaft of the index drive to the output shaft of the intermittent drive at said frequency, said intermittent rotation having an angular displacement that varies in a ratio to the displacement of the output shaft of the index drive in accordance with a setting of the adjustment element.

6. The drive of claim 5 wherein:

the continuously variable transmission means includes a differential drive having three input/outputs shaft, one linked to the output shaft of the index drive, one linked to the adjustment element and one linked to the output of the intermittent drive.

7. The drive of claim 5 wherein:

the transmission further includes a multiple speed gear train connected in series with the continuously variable transmission means between the intermittent drive and the output shaft of the intermittent drive.

8. The drive of claim 7 wherein:

the multiple speed gear train is connected in series with the continuously variable transmission means between the transmission means and the output shaft of the intermittent drive.

9. A machine for performing a process on a web of material, the machine comprising:

a web supply of the web material for supplying the web material along a path;

a processing station for operating on a length the material at station;

a web feeding mechanism for advancing the web along the path from the supply to the processing station;

a drive motor;

a displacement adjustment element;

a variable displacement intermittent motion transmission connected between the drive motor and the feeding mechanism, the transmission including:

an input shaft linked to the motor;

an output shaft linked to the feeding mechanism;

an indexing mechanism linked to the input shaft for producing intermittent unidirectional motion cycles at a frequency that is proportional to the speed of the motor;

a variable displacement drive linked to the output shaft and operable to vary the length of material that is fed to the processing station during each intermittent cycle of the indexing mechanism in accordance with a setting of the displacement adjustment element.

10. The drive of claim 9 wherein:

the processing station includes a cut-off mechanism for operating on the material by cutting off a length of material fed from the web in accordance with the operation of the variable displacement drive.

11. The drive of claim 9 wherein:

the variable displacement drive includes a differential drive having three input/outputs, one linked to the index drive, one linked to the displacement adjustment element and one linked to the output shaft.

12. The drive of claim 9 wherein:

the transmission further includes a multiple speed gear train connected in series with the variable displacement drive.

13. The drive of claim 12 wherein:

the multiple speed gear train is connected at the output of the transmission.

* * * * *

UNITED STATES PATENT AND TRADEMARK OFFICE

CERTIFICATE OF CORRECTION

PATENT NO. : 6,363,823 B1
DATED : April 2, 2002
INVENTOR(S) : Myers et al.

It is certified that error appears in the above-identified patent and that said Letters Patent is hereby corrected as shown below:

Column 6,
Line 52, replace "output shaft, each cycle having a motion that included" with -- input shaft, each cycle having a motion that includes --;
Line 56, replace "a angular" with -- an angular --;
Line 58, replace "couple to the input shaft of the drive an a output shaft" with -- coupled to the input shaft of the drive and an output shaft --;
Line 62, replace "displacement member" with -- displacement adjusting member --; and
Line 63, replace "three input/output" with -- three input/outputs --.

Column 7,
Line 4, replace "differential" with -- differential drive --.
Line 33, replace "three input/outputs shaft," with -- three input/outputs, --; and
Line 35, replace "linked to the output" with -- linked to the output shaft --.

Signed and Sealed this

Eighth Day of October, 2002

*Attest:*

*Attesting Officer*

JAMES E. ROGAN
*Director of the United States Patent and Trademark Office*